US005493544A

United States Patent [19]

Marthe

[11] Patent Number: 5,493,544

[45] Date of Patent: Feb. 20, 1996

[54] NOBLE METAL WATCH CASE

[76] Inventor: Claude-André Marthe, Combe-Grède 19, CH-2613 Villeret, Switzerland

[21] Appl. No.: 250,563

[22] Filed: May 27, 1994

[30] Foreign Application Priority Data

May 28, 1993 [CH] Switzerland ..... 610/93

[51] Int. Cl.[6] ..... G04B 37/22

[52] U.S. Cl. ..... 368/281; 368/282; 368/278

[58] Field of Search ..... 368/280, 282, 368/281, 276, 278

[56] References Cited

FOREIGN PATENT DOCUMENTS 335459 7/1920 Germany ..... 368/280

68695 4/1915 Switzerland ..... 368/281

681414 3/1993 Switzerland ..... 368/280

*Primary Examiner*—Bernard Roskoski

*Attorney, Agent, or Firm*—McGlew and Tuttle

[57] ABSTRACT

The caseband (1) of the watch case comprises a central body (10) onto which a peripheral body (20) is secured in a detachable manner. In order to diminish the weight of noble metal of the case and thus its price, the peripheral body includes a hollow (21) around the circumference of the caseband. A framework (25) formed of a strong but inexpensive material is arranged within the hollow (21), when the two bodies are separated from one another, in order to assure good strength to the case.

20 Claims, 1 Drawing Sheet

NOBLE METAL WATCH CASE

The present invention concerns a watch case formed of a noble metal, also called precious metal, as for example gold, silver or platinum. It concerns more specifically a watch case including a caseband, a back cover and a crystal and in which the solid portions of the caseband are hollowed out in order to diminish the weight of precious metal in the case and thus its price.

BACKGROUND OF THE INVENTION

Such watch cases are well known. In the existing products, the hollowing-out of the solid portions of the caseband is obtained by machining from the recess intended to receive the horological movement, the hollow portions thus produced being concealed by the casing ring, secured on the caseband and supporting the movement.

The saving in weight of precious metal is, as well understood, that much greater as the hollow is deep. However, the more substantial the hollow, the more the wall of the caseband becomes thin and the case fragile, principally in respect of shocks to the outer face and stresses, often substantial, appearing for example at the winding stem passage and the horns.

In order that the case maintain sufficient strength, reinforcement pieces are welded onto critical locations and the horns do not include any hollowing-out.

Now, according to the law, (Swiss Federal Law 941.31, Jun. 20, 1933) every piece added to a watch case of noble metal must also be of noble metal if it is secured permanently onto the case, or be readily separable from the case without special tools should the piece be of a base metal or base metal alloy.

Under these conditions, given that the reinforcement pieces are welded onto the caseband, they must likewise be of noble metal. This constitutes an important drawback since these pieces increase the weight of the case and the securing thereof, its manufacturing cost. The necessity of maintaining massive horns constitutes another drawback since the weight of the horns represents a substantial portion of the overall weight of the case.

The purpose of the invention is to propose a watch case of noble metal not showing these drawbacks.

SUMMARY OF THE INVENTION

To attain this objective, the watch case according to the invention is principally noteworthy in that it further includes a framework which is arranged in a detachable manner within the hollow of the caseband.

An advantage of the invention comes from the fact that the framework, being detachable, can be formed of an ordinary inexpensive material.

Another advantage results from the fact that a part of the framework, if it is for example of metal, can be arranged in the hollows formed in the horns which are thus reinforced whilst exhibiting a lesser weight of precious metal.

Other characteristics and advantages of the present invention will appear from the description which is to follow made in respect of the annexed drawing and giving by way of explanation, but in no manner limiting, an example of such a watch case. On such drawing, the same references relate to analogous elements.

DESCRIPTION OF THE PREFERRED EMBODIMENTS

Figure 2:
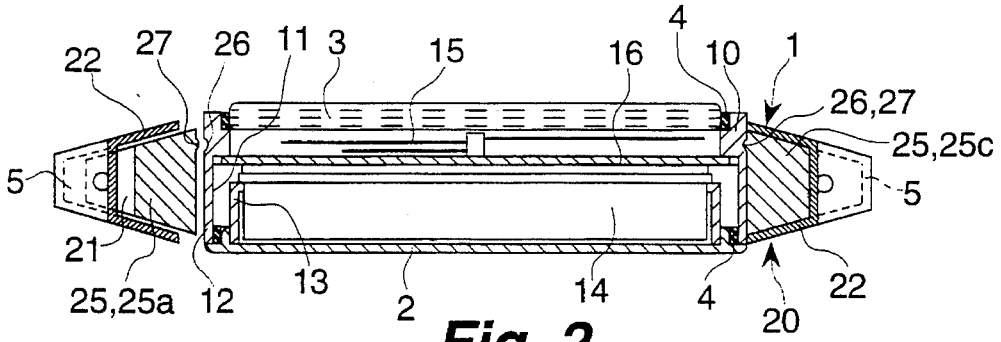
FIG. 2 shows the watch case of FIG. 1 in profile and in cross-section on a plane II—II passing through the center thereof.
Figure 1:
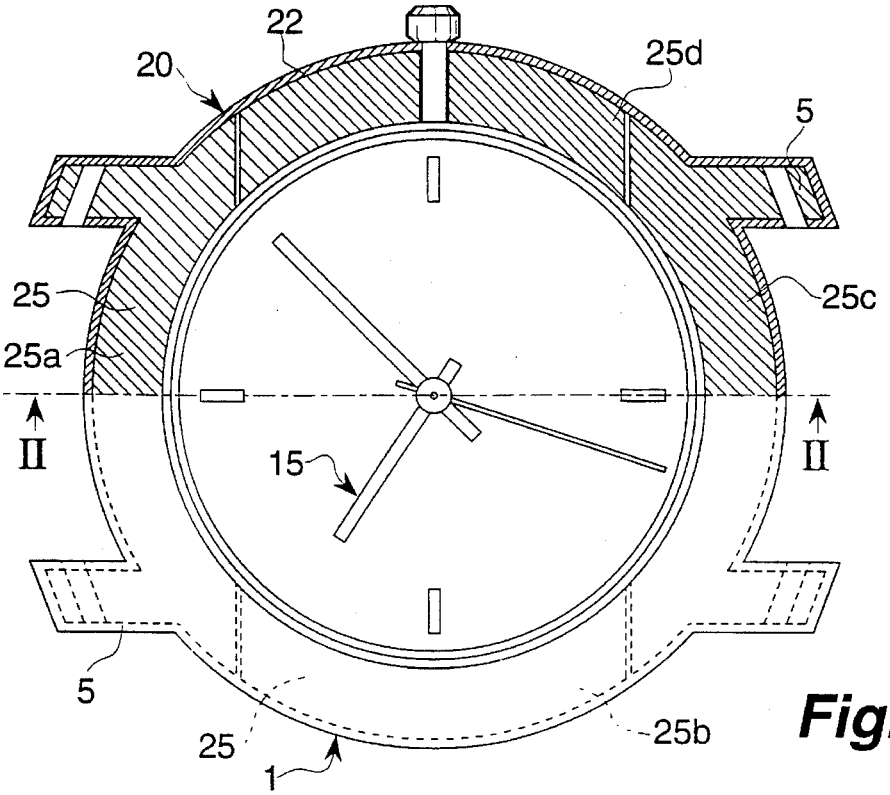
FIG. 1 is a plan view, a portion of which is shown in cross-section, of an embodiment of the watch case according to the invention.

FIGS. 1 and 2 represent an embodiment of the watch case according to the invention. Such case basically includes a caseband 1, a back cover 2 and a crystal 3. The back cover and the crystal are secured onto the caseband in a known manner, in possibly making use of watertight seals 4 in order to render the case impermeable. The caseband 1, of round form and including horns 5 for securing a bracelet, not shown, is formed in the present example of two portions in precious metal, fitting into one another.

One of the portions is formed by a central body 10 of cylindrical form. Such body, which exhibits an inner face 11 and an outer face 12, supports the back cover 2, maintained in place by a snap securing arrangement, and the crystal 3. Within the space bounded by face 11, the back cover and the crystal, there is located a casing ring 13 in which is arranged an horological movement 14 driving hands 15 in front of a dial 16. The casing ring 13 can be secured onto the caseband 1 or, indeed, as in the present example, be maintained in place by the back cover 2.

The other portion of the caseband is a peripheral body 20 of annular form secured onto the outer face 12 of the central body 10 and comprising horns 5. The body 20 includes a hollow 21 which extends to the ends of horns 5 and opens out to the exterior by an opening extending over the circumference of body 10 facing the exterior face 12. This arrangement appears clearly on the lefthand portion of FIG. 2 which is an exploded cross-section of the case over plane II—II passing through its center. The peripheral body 20 can also be considered as being formed from a thin wall 22, folded over on itself in a manner such that its edges come into contact with the outer face 12 of the central body 10 proximate the back cover 2 and crystal 3.

The central body 10 with the back cover 2 and crystal 3 confers rigidity to the case while the peripheral body 20 is an element of decorative nature subjected, however, to shocks and to the pulling forces of the bracelet. Body 20, the form of which is generally complex, can be advantageously obtained by stamping, moulding or by electroforming.

In order to obtain a watch case in which the weight of noble metal is small, the wall 22 of the peripheral body 20 must be thin. The body 20 being however subjected to stresses which may be substantial, it must exhibit a sufficient strength in order not to undergo deformation. This is obtained by arranging in hollow 21 a framework 25 formed of a strong material, but one which is common and inexpensive.

The framework 25 has a form complementary to that of the hollow 21 and its face which is not covered by wall 22 comes into contact with the exterior face 12 of central body 10. It thus entirely fills up the hollow 21 and penetrates to the ends of horns 5. In these conditions, if the framework 25 is for example of brass, the strength of body 20 and horns 5 will be high, mainly where the bar retaining holes are located, and even greater than that of an identical piece formed of solid noble material such as gold or silver.

The form of hollow 21 as a ring laterally open towards the center of the case prevents placing therein a rigid framework forming one and the same piece. To overcome this difficulty, the framework 25 has been divided into four independent segments of substantially equal length, referenced respectively 25*a*, 25*b*, 25*c* and 25*d*.

Segments 25*a* and 25*c* include projecting portions intended to take up the space in horns 5 and they are for this reason introduced initially into hollow 21, respectively at 12 o'clock and 6 o'clock. Next, segments 25*b* and 25*d* are introduced, this last segment including a passage for the time setting stem, these segments being slid into the hollow 21 at 9 o'clock and 3 o'clock between segments 25*a* and 25*c*. In order to permit an easy introduction of the segments into hollow 21 without play, the facing ends of any two adjacent segments come into contact with one another along a plane oriented substantially parallel to the axis 3 o'clock–9 o'clock. By slightly inclining the plane relative to this axis, it is possible to create a stress between the segments by a jamming effect, bringing about a still firmer maintenance of the segments in their housing.

Finally, the peripheral body 20 and framework 25 are slid onto the central body 10 along its outer face 12 in order to give the watch case its definitive form. In order to maintain the two bodies assembled, face 12 furthermore includes a peripheral groove 26 and framework 25 a bead 27 facing the groove and forming therewith a case snap fastening arrangement or means not requiring any special tooling for assembly as well as for disassembly of the case and the framework 25.

Given that segments 25*b* and 25*d* are mainly subjected to local pressure resulting from shocks undergone by caseband 1, they could be formed of a synthetic material exhibiting good compression strength. Segments 25*a* and 25*c* could also be of synthetic material if, the bracelet being connected to the case in a different manner, the latter were not to include horns 5.

Figure 3:
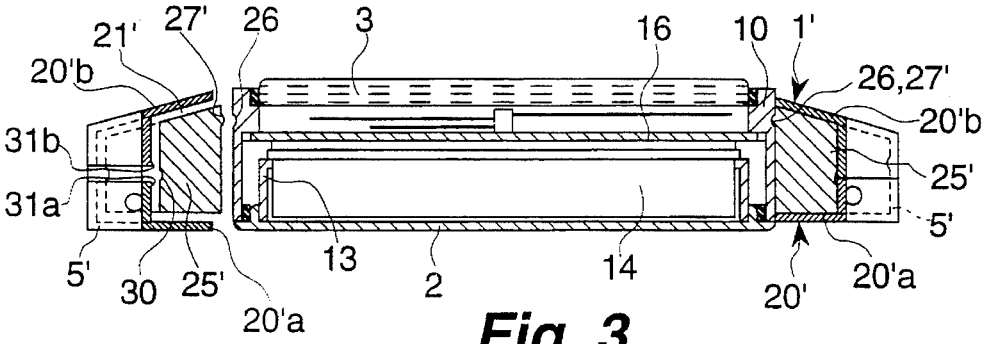
FIG. 3 is a profile view and a cross-section of another embodiment of the watch case according to the invention.

Another embodiment of the watch case according to the invention is shown in profile and cross-section on FIG. 3. In this embodiment, the caseband, referenced 1', comprises a central body which is identical to the central body 10 already described and a peripheral body 20' provided with horns 5'. Body 20' of a form similar to the peripheral body 20 includes a lower portion 20'*a* surrounding back cover 2 and an upper portion 20'*b* surrounding crystal 3. The lateral facing surfaces of the two portions join together along a plane parallel to the principal plane of the watch case and passing substantially through the center of body 20' and horns 5'. On the interior of body 20' a hollow 21' similar to hollow 21 is formed, the interior side face of which is cylindrical and perpendicular to the plane of the case.

Under these conditions, when portions 20'*a* and 20'*b* are separated, it is possible to introduce into one of these portions a framework 25' which can be in a single piece under these conditions, then to apply the other portion onto the framework in order to enclose it within the hollow 21' of the peripheral body 20' and horns 5'. The maintenance of the two portions 20'*a* and 20'*b* on framework 25 is obtained by means of a peripheral snap fastening means including beads 31*a*, 31*b* on body 20' and a groove 30 on the lateral outer face of the framework. The peripheral body 20' can next be arranged and secured onto the central body 10 in the same manner as the peripheral body 20, the framework 25' including to this effect a bead 27'.

It is quite evident that the watch case which has just been described can undergo still other modifications and appear in other variants evident to the person skilled in the art, without departing from the framework of the present invention. In particular, the case, instead of being round, could have a different form, for example oval or rectangular, and the crystal 3 could include a bezel. The bracelet could be coupled to the case by an attachment arrangement not necessitating the presence of horns 5, 5'. The back cover 2 could form part of the central body 10, or likewise as one of the parts of peripheral body 20'. Securing means other than the snap arrangement, for example screws, could be used in order to maintain the different parts of the case assembled. Finally, the control and/or correction elements of the watch could be for example push-pieces in place of the time setting stem.

What is claimed is:

1. A watch case comprising:

a caseband including bracelet attaching means connected to said caseband and for attaching a bracelet to said caseband, said bracelet attaching means protruding from said case and said caseband and said bracelet attaching means defining a hollow, said hollow extending into said bracelet attaching means;

a framework removably and detachably positioned within said hollow, said framework means having extensions extending into said hollow;

a crystal attached to said caseband;

a back cover attached to said caseband.

2. A watch case in accordance with claim 1, wherein:

said caseband is formed from a noble metal;

said framework is formed from one of a base metal, a base metal alloy and a synthetic material.

3. A watch case in accordance with claim 1, wherein:

said bracelet attaching means are formed as a two pairs of horns.

4. A watch case in accordance with claim 1, wherein:

said caseband includes a central body supporting said back cover and said crystal, said caseband also including a peripheral body detachably secured to said central body, said central body and said peripheral body defining said hollow between each other.

5. A watch case in accordance with claim 4, wherein:

said peripheral body is formed from a single integral piece and said framework is formed from a plurality of separate pieces which are positionable adjacent each other in said hollow when said peripheral body and said central body are separated.

6. A watch case in accordance with claim 4, wherein:

said peripheral body is formed of a first portion adjacent said back cover and a second portion adjacent said crystal, one of said first and second portions of said peripheral body being detachably connected to said central body;

said framework is formed from a single integral piece.

7. A watch case in accordance with claim 1, wherein:

said back cover formes a part of said caseband.

8. A watch case in accordance with claim 1, wherein:

said framework is non-integral and non-homogeneous with said caseband, and said framework is mechanically interlocked with said caseband.

9. A watch case in accordance with claim 1, wherein:

said framework and said caseband are repetitively separable without substantially altering a physical shape of said framework and said caseband, and said framework is mechanically interlocked with said caseband.

10. A watch case in accordance with claim 4, wherein:

said framework and said central body have case snap fastening means for snap fastening said framework to said central body.

11. A watch case in accordance with claim 10, wherein:

said framework positively locks said peripheral-body to said central body by an interference fit.

12. A watch case in accordance with claim 10, wherein:

said case snap fastening means includes a bead on one of said framework and said central body, and said case snap fastening means includes a groove defined by another one of said framework and said central body.

13. A watch case in accordance with claim 4, wherein:

said peripheral body is formed of two separate portions, and said two separate portions are connected to said frame work by peripheral snap fastening means.

14. A watch case in accordance with claim 13, wherein:

said peripheral snap fastening means includes a bead on one of said framework and said two separate portions, and said peripheral snap fastening means includes a groove defined by another one of said framework and said two separate portions.

15. A watch case in accordance with claim 1, wherein:

said framework substantially completely fills said hollow defined by said caseband and extending into said bracelet attaching means.

16. A watch case in accordance with claim 5, wherein:

said plurality of separate pieces of said framework is shaped to lock each other into said hollow when all of said separate pieces are positioned in said hollow.

17. A watch case in accordance with claim 5, wherein:

an interface between adjacent said pieces of said framework is shaped to form a jamming effect when all of said separate pieces are positioned in said hollow.

18. A watch case in accordance with claim 5, wherein:

said bracelet attaching means is formed as first and second pairs of hollow horns;

a first piece of said separate pieces of said framework has first and second extensions extending into said first pair of horns;

a second piece of said separate pieces of said framework has first and second extensions extending into said second pair of horns;

a third piece of said separate pieces of said framework is positioned and shaped to lock said first and second piece in said peripheral body.

19. A watch case comprising:

a caseband including bracelet attaching means connected to said caseband and for attaching a bracelet to said caseband, said bracelet attaching means being formed as two pairs of horns, said caseband and said bracelet attaching means defining a hollow, said hollow extending into said horns;

framework means positioned within said hollow and for strengthening said caseband and said bracelet attaching means, said framework means being designed to be repetitively mechanically separable and demountable from said caseband, said framework means having extensions extending into said horns.

20. A watch case in accordance with claim 19, wherein:

said framework means is annular in shape and surrounds a horological movement.

* * * * *